United States Patent [19]

Lowe

[11] 4,421,236

[45] Dec. 20, 1983

[54] LINERLESS CARTON INCLUDING EASILY OPENABLE POURING SPOUT

[75] Inventor: Robert E. Lowe, Battle Creek, Mich.

[73] Assignee: General Foods Corporation, White Plains, N.Y.

[21] Appl. No.: 395,760

[22] Filed: Jul. 6, 1982

[51] Int. Cl.[3] ..... B65D 5/66; B65D 5/10

[52] U.S. Cl. ..... 206/621; 206/624; 206/626; 229/17 R; 229/7 R; 229/37 E

[58] Field of Search ..... 229/17 R, 17 B, 37 R, 229/37 E, 44 R, 43, 7 R; 206/621, 624, 626

[56] References Cited

U.S. PATENT DOCUMENTS

| | | | |
|---|---|---|---|
| 1,415,543 | 5/1922 | Gannon | 229/7 R |
| 2,108,431 | 2/1938 | Cornwall | 229/7 R |
| 2,218,670 | 10/1940 | Bennett | 229/17 G |
| 2,398,404 | 4/1946 | Brooks | 229/37 E |
| 2,434,756 | 1/1948 | Brooks | 229/37 E |
| 2,474,523 | 6/1949 | Guyer | 229/37 E |
| 2,933,230 | 4/1960 | Yezek | 229/17 R |
| 3,145,630 | 8/1964 | Moore | 493/87 |
| 3,162,100 | 12/1964 | Rein et al. | 493/102 |
| 3,191,848 | 6/1965 | Meyers | 229/44 R |
| 3,369,652 | 2/1968 | Bebout | 229/37 E |
| 3,426,956 | 2/1969 | Frohlicher | 229/17 R |
| 3,484,034 | 12/1969 | Sternau | 229/7 R |
| 3,640,446 | 2/1972 | Grieve | 229/17 R |
| 3,695,504 | 10/1972 | Simpson | 229/7 R |
| 3,733,022 | 5/1973 | Kapiloff | 229/7 R |
| 3,956,865 | 5/1976 | Schmermand | 53/456 |
| 4,034,644 | 7/1977 | Schmermand | 493/292 |
| 4,249,693 | 2/1981 | Diaz | 229/43 |

*Primary Examiner*—Steven M. Pollard
*Assistant Examiner*—Bryon Gehman
*Attorney, Agent, or Firm*—Walter Scott; Thomas R. Savoie; Daniel J. Donovan

[57] ABSTRACT

The present invention relates to a carton which is adapted for packaging of contents which consist of granular, powdery or flaked products of the free-flowing type or of bulk commodities. The carton particularly relates to a linerless paperboard carton which includes an easily openable pouring spout which may be readily reclosed so as to maintain the carton in a positive closed condition after initial opening thereof and to thereby extend the pantry shelf-life of the package and to protect any product remaining in the carton from inadvertent spillage.

13 Claims, 5 Drawing Figures

LINERLESS CARTON INCLUDING EASILY OPENABLE POURING SPOUT

BACKGROUND OF THE INVENTION

1. Field of the Invention

The present invention relates to a carton which is adapted for the packaging of contents which consist of granular, powdery or flaked products of the free-flowing type or of bulk commodities and, more particularly, relates to a linerless paperboard carton which includes an easily openable pouring spout which may be readily reclosed so as to maintain the carton in a positive closed condition after initial opening thereof and to thereby extend the pantry shelf-life of the package and to protect any product remaining in the carton from inadvertent spillage.

Generally, cartons which are utilized for the storage and dispensing of types of products as mentioned hereinabove, particularly those employed for dry cereals, consists of the combination of a paperboard carton and a product-containing liner in the form of a closed sack or package, the latter of which usually is constituted of waxed glassine paper or high-density polyethylene. Subsequent to the opening of the carton and the liner, in order to reseal the contents remaining therein, the liner must be refolded to provide protection for the remaining portions of the product. Frequently, a consumer will not properly refold and close the liner after use, or the liner may be ripped or otherwise damaged during refolding so as to destroy the integrity thereof, thereby adversely affecting product quality, particularly comestibles, and causing rapid deterioration thereof, thereby drastically curtailing the pantry shelf-life of the product. When employing plastic resin-based liners, there is often encountered a memory phenomenon in the liner material itself which tends to unfold or unroll, with the liner then opening to thereby result in a reduced pantry shelf-life for the package.

More recently, linerless cartons have been developed for the storage of products of the type set forth hereinabove, particularly dry cereals, in which an easily openable pouring spout is provided at the top of the carton by tearing open a portion of the carton top structure, which may then again be closed after dispensing a portion of the product through the provision of a closure tab or "tuck-in" type of construction which interengages with or tucks below other carton wall components. This type of construction frequently does not provide the necessary sealing of the product remaining with the carton with respect to the exterior so as to cause the remaining product stored in the carton to rapidly deteriorate, thereby drastically reducing pantry shelf-life of the carton and its contents. Furthermore, a linerless carton of this type which incorporates an easily opening and recloseable pouring spout frequently necessitates the utilization of excess amounts of board or carton stock in forming of the carton blank. Additionally, these cartons generally require the incorporation of complex scoring and weakening line patterns which render the cartons relatively expensive to manufacture, while reducing die cutting speeds in forming the blanks and, consequently, become somewhat impractical from a commercial viewpoint. Moreover, the tuck-in type of flap structure for the carton wall portion which forms the openable and recloseable pouring spout frequently fails to positively reclose upon being tucked in due to misalignment of the edges and may lead to accidental spilling of the remaining contents of the carton during tilting or inadvertent inversion of the carton.

2. Discussion of the Prior Art

Thus, Grieve U.S. Pat. No. 3,640,446 discloses a carton with a tucked-in closure flap, in which a dispensing orifice or pouring spout is provided for through the intermediary of weakening or score lines extending across the closure flaps to provide readily end sections thereon which are severable therefrom and which are hinged to the carton wall or panel structure. In this instance, although the carton pouring spout or closure lap is generally quite satisfactory in operation, precise registration and alignment is required for the severing lines of the inner and outer flap overlapping portions. Since only two opposite corners of a portion of the top corner flap tuck under upon reclosing of the carton, this will not afford a high degree of positive closing and may allow for accidental opening of the carton.

Yezek U.S. Pat. No. 2,933,230 discloses a carton providing for a pouring spout constructed through the provision of weakening or score lines on the carton top flaps, and including a tuckable end flap member disposed beneath the side flaps. In this instance, in order to open the carton to form a pouring spout, and subsequently to reclose the pouring spout, the tucked portion of the end flap must be pulled outwardly into an unfolded position, and thereafter refolded prior to the closing of the side flaps. Although this structure incorporates a dust flap formed with a finger cut-out which is disposed in register with a finger cut-out in the tear-away or removable portion of the inner closure flap, these elements are not unitarily openable since they bend about different hinge lines which are at right angles to each other.

Schermund U.S. Pat. No. 3,956,865 discloses a container which incorporates a recloseable spout or opening of the so called "flip-top" type, which is frequently employed in the formation of semi-rigid cigarette packets. This type of closure construction is, however, relatively complex and does not necessitate a type reclosing which would completely seal the remaining product contained in the package for the purpose of providing an extending pantry shelf-life. The container closure set forth in this patent is primarily for the purpose of providing protection against crushing the contents, in this instance cigarettes, to thereby prevent these from becoming unusable and to also preclude any inadvertent sliding out of the cigarettes from the package.

Cornwall U.S. Pat. No. 2,108,431 discloses a recloseable pouring spout located on the top surface of a rectangular paperboard carton. The pouring spout, however, is not integrally formed with the carton but rather is constructed of a separate metallic cutting and closure forming member. This represents an extremely cumbersome and expensive structure which would not be readily and economically suitable for a single-use or throwaway type of carton.

Kapeloff U.S. Pat. No. 3,733,022 describes a box-like carton having a detachable top incorporating recloseable end member or flap for resealing the opened end wall of the carton. Again, this requires essentially a two-piece container construction which is difficult and expensive to manufacture and which does not always provide the necessary degree of resealing of the pouring spout or opening.

Other recloseable containers are illustrated in Simpson U.S. Pat. No. 3,695,504; Schermund U.S. Pat. No.

4,034,655; Rein et al. U.S. Pat. No. 3,162,100; Diaz U.S. Pat. No. 4,249,693; Sternau U.S. Pat. No. 3,484,034; Bennett U.S. Pat. No. 2,218,670; and Moore U.S. Pat. No. 3,145,630.

Another carton which is currently being marketed commercially discloses a top which can be pivoted relative to the carton body so as to form a dispensing opening extending across the entire carton top. There is no disclosure of a pouring spout being formed towards one end only of the carton.

SUMMARY OF THE INVENTION

Accordingly, in order to obviate or ameliorate the limitations encountered in the prior art carton constructions, particularly those of the linerless type, the carton according to the present invention provides for a structure which only necessitates the utilization of a minimum amount of board or other carton stock material, and which incorporates an integrally formed, easily openable and resealable pouring spout affording foolproof opening and closing, with the reclosure being sufficiently tight to prevent accidental spillage of the remaining contents within the carton.

More specifically, the present invention provides for a linerless paperboard carton which is employed for longlife storage and dispensing of products consisting of granular, powdery or flaked materials or readily flowable bulk goods, such as dry cereal products. In particular, the carton enables the package to be easily opened and resealed so as to maintain the product freshness and extend the pantry shelf-life of the carton. In essence, this is accomplished in the carton construction pursuant to the invention in that the top flap construction of the carton includes a plurality of parallel spaced crease or fold lines which, prior to the closing and glueing of the carton, are adapted to fold back the edges of the flaps extending about the periphery of the carton so as to form a depending flange about the upper edge of the carton which extends in close surface contact with the outer surface of the carton wall panels to form a substantially rigid reinforcing edge structure. A suitable tear line is formed in one end panel of the carton along the upper edge thereof and along adjacent edge portions of the opposite side panels, the ends of the tear line being joined by a die cut, and with a score line extending across the top surface of the carton between die cuts so as to allow for the easy upward pivotal movement of that section of the carton about the score line upon separation of the tear line. This will form an upwardly pivotable flap which forms a pouring spout permitting dispensing of product from the carton. The upwardly displaced flap may be subsequently pivoted downwardly into closing position so that the peripheral depending flange portion again engages along its entire length the outer surface about the upper edge of the carton, and thereby forms a sealed closure which will prevent the spillage of the carton contents upon tilting or inversion of the carton. Concurrently, the carton will also be resealed from contact by any contaminents from exteriorly of the carton, thereby appreciably increasing the pantry shelf-life of the carton.

In another aspect of the invention, the linerless paperboard carton pursuant to the present invention provides for a barrier coating or laminate which eliminates the need for a separate liner in order to maintain the freshness or integrity of the product which is stored in the carton. In esence, the carton is constructed from a single sheet of flat paperboard, which can be externally and/or internally coated or laminated with a moisture-oxygen impervious barrier material, such as wax, copolymer, high-density polyethylene or the like, which will provide extended pantry shelf-life and long-term product protection.

Accordingly, it is a primary object of the present invention to provide for a novel and improved carton which includes a resealable pouring spout integrally formed with the carton.

A more specific object of the present invention is to provide for a paperboard carton of the linerless type which incorporates an openable and recloseable pouring spout integrally formed with the carton and which includes a barrier coating material or laminate applied to the surface of the carton so as to provide a moisture-oxygen impervious carton construction which will greatly extend the pantry shelf-life of the carton.

Still another object of the present invention is to provide for a carton of the type described, which is readily resealable and incorporates a positive recloseable and spillproof closure for the contents therein irrespective of the physical position or orientation of the carton.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
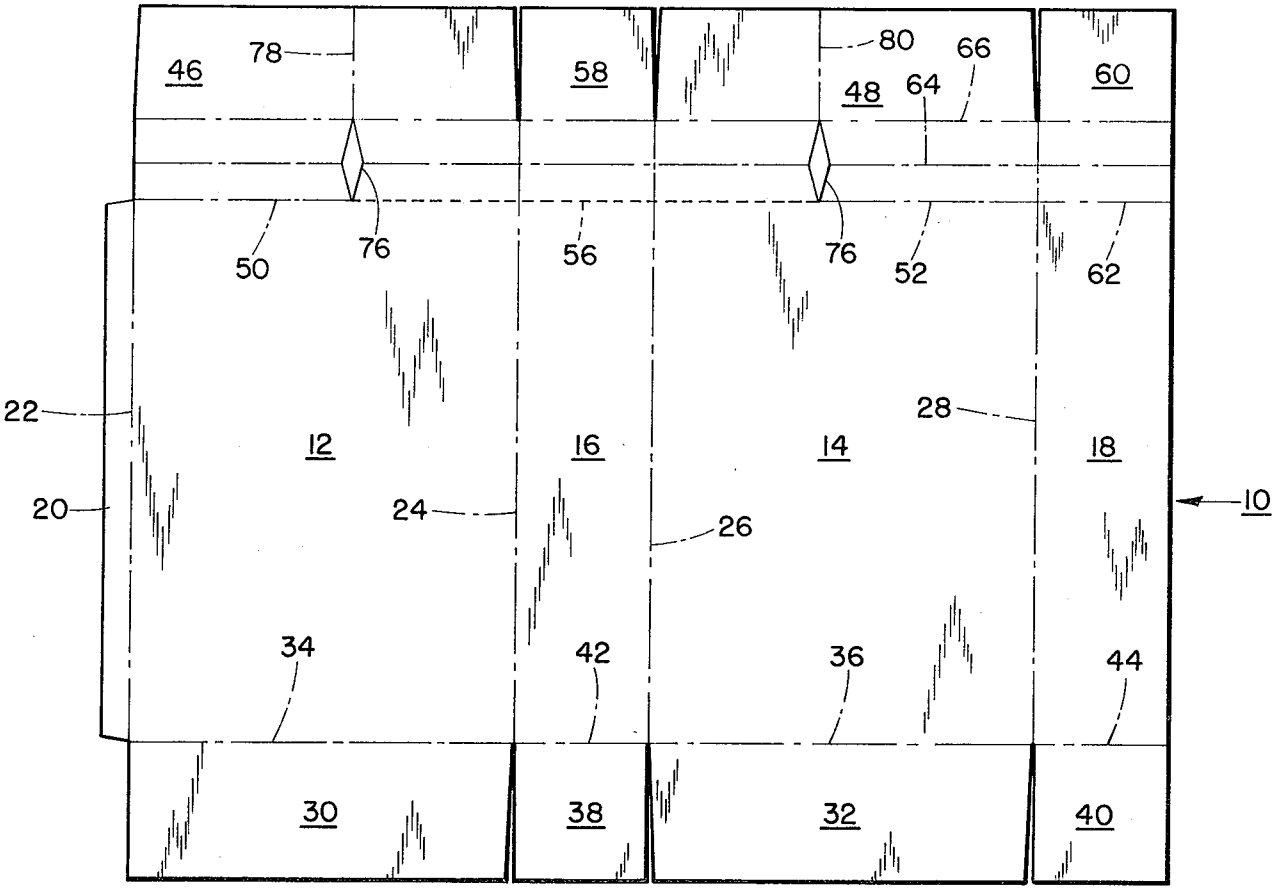
FIG. 1 illustrates a plan view of a carbon blank for erecting of a carton pursuant to the present invention.
Figure 3:
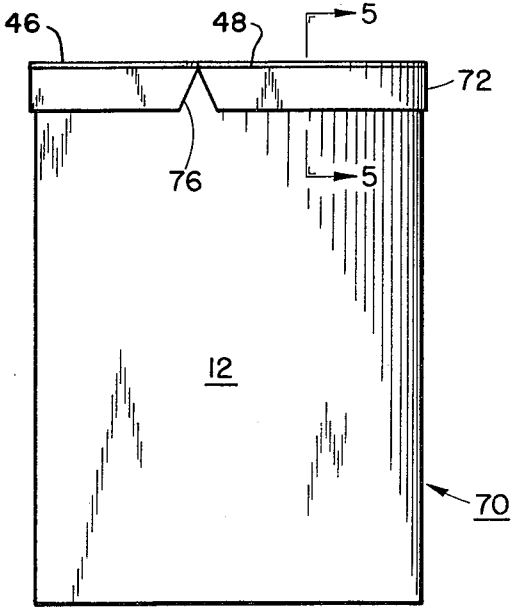
FIG. 3 illustrates a side elevational view of the carton of FIG. 2.
Figure 2:
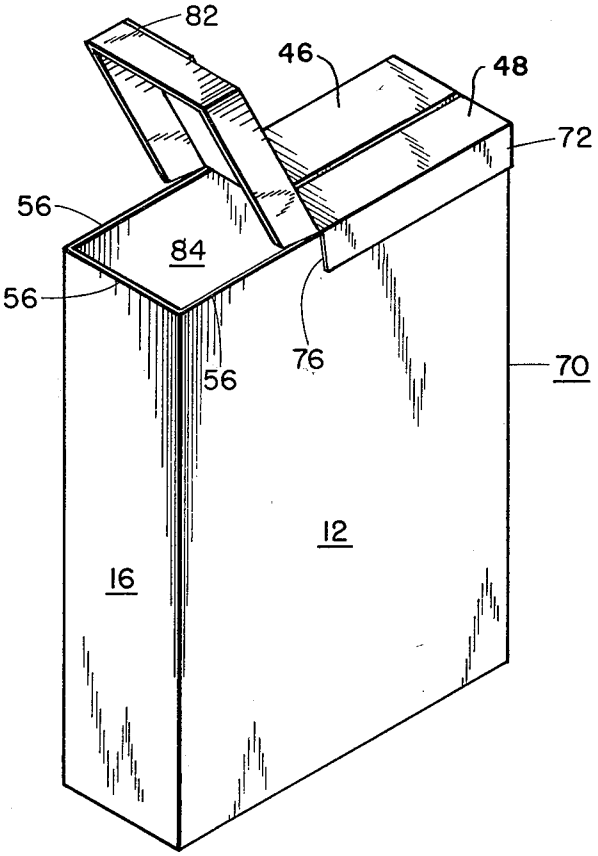
FIG. 2 illustrates a perspective view of a carton incorporating the novel pouring spout, with the pouring spout being shown in an opened condition.
Figure 4:
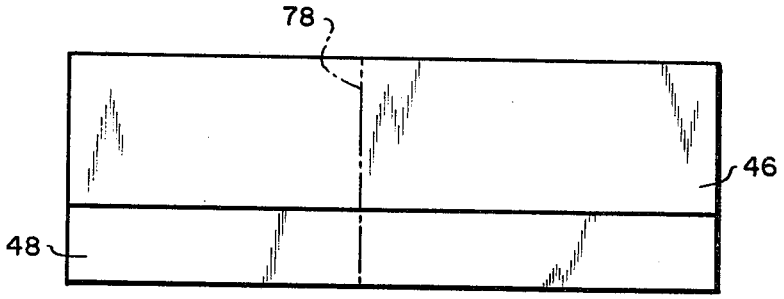
FIG. 4 illustrates a top plan view of the carton of FIG. 2.
Figure 5:
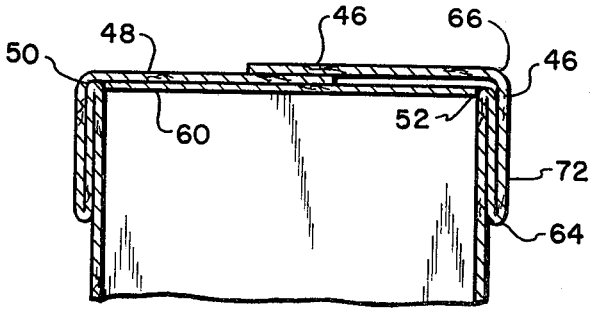
FIG. 5 shows on an enlarged scale a fragmentary sectional view taken along line 5—5 in FIG. 3.

Referring now in detail to the drawings, and particularly FIG. 1, a linerless carton pursuant to the present invention is constructed from a carton blank 10 which may be cut from a continuous web of cardboard, such as boxboard, paperboard or other semi-rigid packaging material, in a manner well known in the art. The carton blank 10 illustrated in FIG. 1 of the drawings is designed to be erected into a generally rectangularly-shaped carton and discloses a surface of the blank which is adapted to ultimately form the exterior surface of the finished carton.

The carton blank 10 is divided into a plurality of suitably arranged panels or walls and flaps through the intermediary of either fold or tear lines, described in detail hereinbelow. The carton blank panel and flap components include a carton front or face panel 12 which may be considered to constitute the front wall of the resultant erected carton, and a rear panel 14 adapted to form the rear wall of the carton. A first end panel 16 is arranged intermediate the front and rear panels 12 and 14, and a further end panel 18 joins the rear panel 14, whereas the front panel 12 is joined by a glue flap 20 adapted to be adhesively bonded to the interior surface of the end panel 18. The carton panels are separated by, respectively, score or fold lines 22, 24, 26 and 28.

The bottom of the carton may be constructed of conventional side closure flaps 30 and 32 which are extensions of, respectively, front and rear panels 12 and 14, and are separated from these panels by score or fold lines 34 and 36. Similarly, end closure flaps 38 and 40 are formed by extensions of, respectively, end panels 16 and 18 and are separated therefrom by score or fold lines 42 and 44. In the erected condition of the carton, the flaps 38 and 40 are adapted to be folded inwardly and thereafter covered by the inward folding of flaps 32 and 30, which are adhered thereto through suitable glue or adhesive material, such as a hot melt or cold resin, applied, as required to the surfaces of the flaps.

The top of the carton which incorporates the inventive easily openable pouring spout, and which is described in greater detail hereinbelow, comprises extensions at the ends of the panels 12, 14, 16 and 18 opposite those forming the bottom carton structure, and include side closure flaps 46 and 48 which are extensions of, respectively, front and rear panels 12 and 14 and are separated therefrom through score or fold lines 50 and 52, and a tear line 56 which may consist of discontinuous slits or perforations extending therebetween in coaxial alignment therewith. Similarly, end closure flaps 58 and 60 are formed by extensions of, respectively, end panels 16 and 18, with the end flap 58 being separated from the end panel 15 through the tear line 56 whereas the end closure flap 60 is separated from the end panel 18 by score or fold line 62.

As illustrated in the drawings, score or fold lines 34, 36, 42 and 44; and respectively, fold lines 50, 52, 62 and tear line 56 may be each constituted of a single or continuous straight line.

The construction of the readily openable and resealable pouring spout of the carton is derived by imparting to the flaps 46, 48, 58 and 62 additional score or fold lines 64 and 66 which extend in parallel spaced relationship with the fold and tear line defined by lines 50, 52, 56 and 62.

Thus, as illustrated in the drawings of FIGS. 2 through 5, the erected carton 70, which is formed from the carton blank 10, has a depending flange 72 extending about the upper edge of the carton. This depending flange 72, prior to the inward folding of the upper closure flaps 46, 48, 58 and 60 to form the carton top is constructed by folding the portion of each of the flaps located between the fold line 50, 52 and 62 and tear line 56 and the fold line 64 outwardly and downwardly, and the portions of these flaps between fold lines 64 and 66 upwardly into parallel surface contact with the previously mentioned portions of these flaps so as to constitute a double-wall thickness flange structure 72 about the carton periphery. The superimposed surfaces of these flap portions forming the flange 72 may then be glued together along contact surfaces 74.

Formed in the flaps 46 and 48 at the juncture between the tear line 56 and fold lines 50 and 52, and extending across the widths defined by fold line 50 and tear line 56 and the fold line 56, and respectively fold line 52, and tear line 56 and the fold line 56 are die cuts 76. In this instance, the die cuts are shown as being essentially diamond-shaped forming an inverted V in each side of the flange, although they can simply be cut lines, or have any other configuration. Extending across the top surface of flaps 46 and 48 are fold line 78 and 80 so as to be located in a superimposed position when the carton is in an erected position. In order to open the carton and to thereby form a pouring spout which will allow for dispensing therethrough of the product contained in the carton, upward pressure may be exerted on the carton forward edge 82 of the peripheral depending flange 72. This will cause the upper flange portion 46, 58 and 48 to be separated from the remainder of the carton along the tear line 56, this portion being pivoted upwardly about the superimposed fold lines 78 and 80, and with this portion of the flap structure still being attached to the carton along that line.

Subsequent to dispensing of a portion of the product through the pouring spout 84 which is formed by the raised flap portion, downward pressure exerted and acting thereon will cause the raised portion of the depending flange 72 to pivot down and engage in close surface contact with the outer surfaces of the panel walls 12, 16 and 14 and thereby provide a positively sealed reclosing of the carton so as to protect the remaining contents contained therein.

Preferably, the carton 70 is constituted of paperboard which may be coated with a suitable material forming a barrier against oxygen and moisture penetration, such as wax, copolymer or high-density polyethylene which will provide product protection and considerably enhance the pantry shelf-life of the product within the carton. Alternatively, the paperboard may be provided with a laminate or layer of a moisture and oxygen-impervious barrier material, as previously mentioned, which may be constituted of wax, copolymer, or high-density polyethylene.

Although the pouring spout formed by the tear line, die cuts and the score line across the top of the carton as shown in this embodiment is represented to constitute approximately one-half of the top surface of the carton so as to provide a relatively large pouring spout, under certain circumstances, depending upon the type of product being stored in the carton, the pouring spout can be constructed so as to define a smaller or larger proportion of the total upper surface area of the carton.

In summation, the present invention thus provide for a unique and novel linerless paperboard carton which is particularly adapted for the long-term pantry storage of dry cereal products. The carton construction enables the package to be easily opened and reclosed so as to maintain product freshness for lengthy periods of time, by providing a pour spout type opening which can be easily reclosed to seal the remaining product within the carton.

While there has been shown and described what are considered to be preferred embodiments of the invention, it should be understood that variations in form and detail could readily be made without departing from the spirit of the invention. It is therefore intended that the invention be not limited to the exact form and detail shown herein and described, nor to anything other than the whole of the invention as hereinafter claimed.

What is claimed is:

1. A carton providing for a recloseable pouring spout for a generally free-flowing bulk commodity or granular, powdered or flaked materials, said carton comprising side and end wall panels; extensions at one end of each of said panels forming bottom closing flaps for said carton, said flaps being inwardly foldable to constitute a carton bottom closure; and extensions at the other end of each of said panels forming top closing flaps for said cartons, said top flaps being inwardly foldable to form a carton top closure, said top closing flaps including outer and inner side flaps and end flaps adapted to underlie said side flaps, a plurality of fold lines being formed on each of said top closing flaps, said fold lines extending in predetermined parallel spaced relationship with the upper ends of said panels, said top closing flaps being foldable outwardly of said carton along said parallel spaced fold lines so as to form a depending flange extending about the upper peripheral edge portions of said panels and in surface contact with the outer surfaces of said panels, a tear line extending between the juncture of the upper edge of said panels and one said end flap and adjoining portions of each adjacent side flap, die cuts extending upwardly through said depending flanges at the ends of said tear line, and a fold line extending across the top closure between the other ends of said die cuts whereby upward pressure exerted on said last-mentioned end flap causes said tear line to sever and facilitate pivotal upward movement of the portion of the top closure encompassed by the tear line about said fold line so as to form said pouring spout, said pouring spout being recloseable responsive to downward pressure being exerted on said raised portion of the top closure and causing sealing engagement between the flange and the outer surfaces of said panels.

2. A carton as claimed in claim 1, said depending flange being formed by a double-walled thickness of said top flaps and being adhesively bonded intermediate said double walls.

3. A carton as claimed in claim 1 or 2, said tear line being formed by a series of discontinuous slits.

4. A carton as claimed in claim 1 or 2, said tear line being formed by a series of perforations.

5. A carton as claimed in claim 1, said pouring spout providing an opening extending over approximately one-half the size of the top surface of said carton.

6. A carton as claimed in claim 1, said pouring spout providing an opening of less than one-half the size of the top surface of said carton.

7. A carton as claimed in claim 1, said die cuts in said flange being of a substantially inverted V-shaped in the erected condition of the carton.

8. A carton as claimed in claim 1, said upwardly pivotable portion of the top closure forming a substantially rectangularly-shaped pouring spout opening.

9. A carton as claimed in claim 1, said carton being a linerless carbon constituted essentially of paperboard.

10. A carton as claimed in claim 9, comprising a coating being applied to at least the exterior surfaces of said paperboard so as to form an oxygen-and moisture impervious barrier on said carton surfaces.

11. A carton as claimed in claim 10, said coating being selected from the group of materials consisting of wax, copolymers, and high-density polyethylene.

12. A carton as claimed in claim 10 or 11, said coating comprising a layer of material laminated to said paperboard.

13. A carton as claimed in claim 1, said carton having a substantially box-like rectangular configuration.

* * * * *